US006475444B1

(12) United States Patent
Zimmermann et al.

(10) Patent No.: US 6,475,444 B1
(45) Date of Patent: Nov. 5, 2002

(54) RINSING TRAY SYSTEM

(75) Inventors: Peter Zimmermann; Uwe Naumann, both of Jena (DE)

(73) Assignee: CyBio Instruments GmbH, Jena (DE)

( * ) Notice: Subject to any disclaimer, the term of this patent is extended or adjusted under 35 U.S.C. 154(b) by 46 days.

(21) Appl. No.: 09/621,313

(22) Filed: Jul. 20, 2000

(30) Foreign Application Priority Data

Jul. 19, 1999 (DE) ..... 199 34 090

(51) Int. Cl.[7] ..... B01L 11/00; B01L 3/00; B01L 3/02; B01L 9/00; B08B 9/00; B08B 9/04; B08B 3/00

(52) U.S. Cl. ..... 422/102; 422/99; 422/104; 422/100; 422/31; 73/864.22; 73/864.02; 134/22.11; 134/166 R; 134/84; 134/85; 134/23; 134/168 C; 134/168 R; 134/167 C

(58) Field of Search ..... 422/99, 100, 102, 422/104, 31; 73/863, 863.32, 864, 864.01, 864.11, 864.16, 864.17, 864.22; 436/180; 134/166 R, 168 R, 168 C, 167 C, 22.11, 23, 84, 85

(56) References Cited

U.S. PATENT DOCUMENTS 3,649,464 A * 3/1972 Freeman
RE30,562 E * 3/1981 Park
5,540,891 A * 7/1996 Portmann et al.
5,759,494 A * 6/1998 Szlosek
5,866,825 A 2/1999 Moore et al.
5,916,526 A * 6/1999 Robbins
5,961,925 A * 10/1999 Ruediger et al.
5,976,470 A * 11/1999 Maiefski et al.
6,054,100 A * 4/2000 Stanchfield et al.
6,106,783 A * 8/2000 Gamble
6,170,494 B1 * 1/2001 Marinaro et al.
6,241,949 B1 * 6/2001 Kane
6,274,091 B1 * 8/2001 Mohan et al.
2001/0019705 A1 * 9/2001 Ruediger et al.

FOREIGN PATENT DOCUMENTS

DE 196 35 004 8/1996

* cited by examiner

*Primary Examiner*—Jill Warden
*Assistant Examiner*—Brian R Gordon
(74) *Attorney, Agent, or Firm*—Reed Smith LLP

(57) ABSTRACT

A rinsing tray system for pipette tips or transfer needles, arranged in the form of a matrix and having a bottom tray and a top tray, protrusions which have through-apertures arranged perpendicular to the base of the top tray and at the same grid spacing from one another as the pipette tips or transfer needles, projecting into the interior of the top tray, wherein the bottom tray having at least one inlet in order to be continuously filled with rinsing liquid and at least one outlet being present on the top tray.

9 Claims, 4 Drawing Sheets

RINSING TRAY SYSTEM

BACKGROUND OF THE INVENTION a) Field of the Invention

The invention relates to a rinsing tray system for cleaning the pipette tips of multipipettors or the transfer needles of replication systems with pipette tips or transfer needles arranged in the form of a matrix.

b) Description of the Related Art

Multipipettors are used in particular in research carried out on active chemical and biochemical substances in order to test a large number of substances (substance libraries) for their effectiveness for an intended purpose (HTS: high throughput screening). Extremely high throughputs are achieved in particular using multipipettors with pipette tips arranged in the form of a matrix. At the current time, multipipettors of this type with 8×12=96 and 16×24=384 pipette tips are in use. By way of example, the commercially available multipipettors produced by Robbins Scientific Sunnyvale, Calif. and OpalJena GmbH (DD Patent 260571) may be mentioned.

In this field, there is a tendency both to have an increasing number of volumes of test substances which are dispensed onto a microtitration plate (MTP) and to minimize the volumes of individual test substances.

While these experiments were previously carried out in MTPs whose wells were arranged in an 8×12=96 well array, able to accommodate a test substance volume of up to 300 ml per well, formats which employ a multiple of this array (16×24=384, 32×48=1536 and 64×96=6144) are becoming increasingly important. The external dimensions of the MTPs used remain the same, irrespective of the well array, so that proceeding from the-center to-center distance of the wells with the 8×12 array of 9 mm, the resultant center-to-center distances for the higher formats are 4.5 mm, 2.25 mm and 1.125 mm. The volume which can be introduced into each well is reduced disproportionately.

For some time, there has been increasing use of replication systems, such as for example those supplied by V&P Scientific Inc., CA, to transfer the test substances.

Replication systems comprise a two-dimensional arrangement of transfer needles of identical diameter and are also used to transfer the test substances in HTS applications. In this case, the transfer needles are advantageously designed in such a way that, when they are immersed in a test substance, test substance in the form of a meniscus adheres only to their end side. In this case, the volume of substance which can be transferred is substantially determined by the diameter of the transfer needles used and can be significantly lower than is possible with the above mentioned multipipettors.

A common requirement for both multipipettors and replication systems is that the pipette tips or transfer needles be cleaned after a substance transfer cycle, in order to prevent contamination of the test substance when it is picked up again and to prevent interference with the next cycle and therefore distortion of the results in subsequent cycles.

In the most simple case, the pipette tips are cleaned by taking up clean rinsing liquid from a first vessel and ejecting it into an adjacent second vessel. A first drawback of a solution of this type is that the two vessels have to be alternately arranged beneath the pipette tips, or else the pipette tips have to be guided over the vessels, and a second drawback is that the outer surface of the pipette tips is not sufficiently cleaned by being immersed in the rinsing liquid, which is essentially free from current, and this drawback also leads to contamination of the clean rinsing liquid with test substance.

The first of the above drawbacks is solved using a rinsing tray system for a multipipettor as described in DE 196 35 004 C1. A rinsing tray system of this type comprises a first tray for holding the unused (clean) rinsing liquid and a second tray for holding the contaminated rinsing liquid, the first tray being arranged resting on top of the second tray, and webs with continuous apertures (through-apertures) are distributed over its base at the same grid spacing as a multipipettor in matrix form.

To carry out the rinsing process, the first tray is filled with the clean rinsing liquid via an inlet. To ensure that the filling level in the first tray does not exceed the height of the webs, which would allow it to drain into the second tray via the through-apertures, an overflow or a filling-level sensor is provided. The pipette tips are then immersed in the clean rinsing liquid, filled with this liquid by suction and are emptied again over the through-apertures, so that the rinsing liquid which is contaminated with residues of the test substance which has previously been pipetted passes into the second tray. It is not important whether the relative movement required is carried out by displacement of the rinsing system or of the pipette tips. A rinsing tray system of this nature has a number of significant drawbacks:

Although the pipette tips are cleaned effectively on the inside by repeatedly sucking up and ejecting the rinsing liquid, the outer surface is only wetted by the clean rinsing liquid. Consequently, residues of the previously pipetted test substance contaminates both a fresh batch of test substance and the rinsing liquid when the rinsing process is repeated.

As the trend towards smaller individual test substance volumes increases, the effects of even the tiniest contamination become more dramatic. Although a rinsing system of this type does allow the rinsing liquid in the first tray to be changed completely after each batch, not only does this consume large quantities of rinsing liquid, but also the operation is time-consuming. Therefore, there is still no effective cleaning of the outer surface, and consequently a rinsing tray system of this type appears to be entirely unsuitable for cleaning transfer needles, since these needles pick up the test substance only via their outer surface.

OBJECT AND SUMMARY OF THE INVENTION

The primary object of the invention is to provide a rinsing tray system for pipette tips or transfer needles which makes it possible to effectively clean pipette tips or transfer needles which are arranged in matrix form without any residues whatsoever and to carry out the rinsing process in a more time-effective manner.

For a rinsing tray system as described above, this object is achieved by the fact that the bottom tray has at least one inlet in order to be continuously filled with rinsing liquid and at least one outlet is present on the top tray.

The rinsing tray system according to the invention does not simply represent a trivial cinematic reversal, since a different arrangement of the means which are known per se results in a completely different action, and therefore a rinsing tray system of this type has features which are different from those known from the prior art. An essential feature of the invention is the continuous filling of the bottom tray with clean rinsing liquid which, in the process, is conveyed via the through-apertures into the top tray and is removed from there. In order to be cleaned, the pipette tips or transfer needles are introduced into the through-apertures. When this takes place, the outer surface of the pipette tips or transfer needles has the clean rinsing liquid flowing around it as a result of the flow generated in the through-apertures, and consequently this surface is cleaned. The residues of test substance which are removed from the surface are conveyed upward in the through-apertures by the flow generated by the continuous feed of clean rinsing liquid and are rinsed over the edge of these apertures.

A decisive advantage over the prior art is that this system reliably avoids the contamination of the container for the clean rinsing liquid which, in a broad sense, includes not only the bottom tray but also the walls surrounding the through-apertures, which project into the top tray as protrusions, as well as the contamination of the clean rinsing liquid located therein. The reliable avoidance of the contamination of the walls surrounding the through-apertures is not only important for preventing contamination of the clean liquid rising up inside these apertures, but also to ensure that, when the pipette tips or transfer needles are reintroduced, when the rinsing process is repeated, these tips or needles are not contaminated again or additionally through contact with the surrounding walls.

Since, in order to be cleaned, the pipette tips or transfer needles are dipped into the through-apertures, the surrounding walls of these apertures, unlike in the prior art, only have to project slightly into the interior of the top tray 1.1, 1.2, forming protrusions of a low height. This leads to the advantageous additional effect that, apart from the required horizontal movement by in each case half the grid spacing in order for the rinsing liquid to be taken up into the through-apertures and released into the top tray, only one vertical movement is required, namely that of lowering the pipette tips or raising the rinsing tray system in order for the tips to be dipped into the through-apertures. Lowering during release of the rinsing liquid is not necessarily required.

A further additional effect consists in the possibility of arranging the through-apertures more closely together and therefore of reducing the grid spacing compared to the prior art, since there is no need for any vent openings. Center-to-center distances of the through-apertures of less than 9 mm, for example of 4.5 mm, 2.25 mm or 1.125 mm, are possible.

There is also no need for an overflow or overflow sensor, which simplifies the construction.

To generate a uniform flow of the rinsing liquid in all the throughapertures, the cross section of these apertures may narrow on the side of the bottom tray in order to restrict the flow.

To ensure that there are no drops formed when the rinsing liquid emerges from the through-apertures and that the continuously conveyed rinsing liquid can flow out, the rim surface around the through-apertures should either be extremely narrow or should form a plane surface which is inclined with respect to the base of the top tray.

To avoid contamination of the rinsing tray system, it is advantageous for those parts which come into contact with the contaminated rinsing liquid and the pipette tips or transfer needles to be made from a suitably hydrophobic material or to be coated with a hydrophobic material.

The invention is to be explained in more detail below with reference to two exemplary embodiments.

DESCRIPTION OF THE PREFERRED EMBODIMENTS

Figure 1:
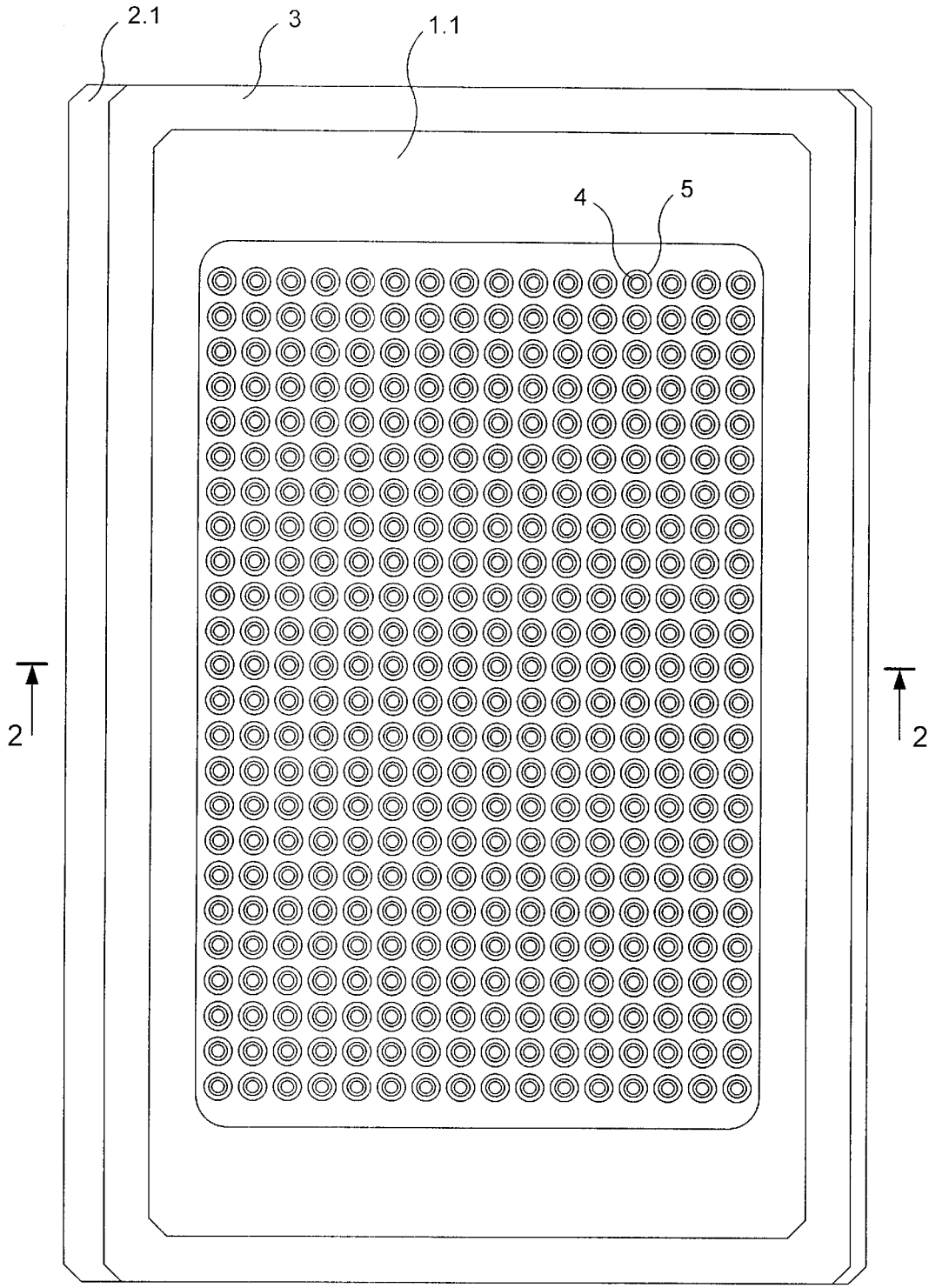
FIG. 1 shows a plan view of a first exemplary embodiment, in which the through-apertures are formed by small tubes.
Figure 2:
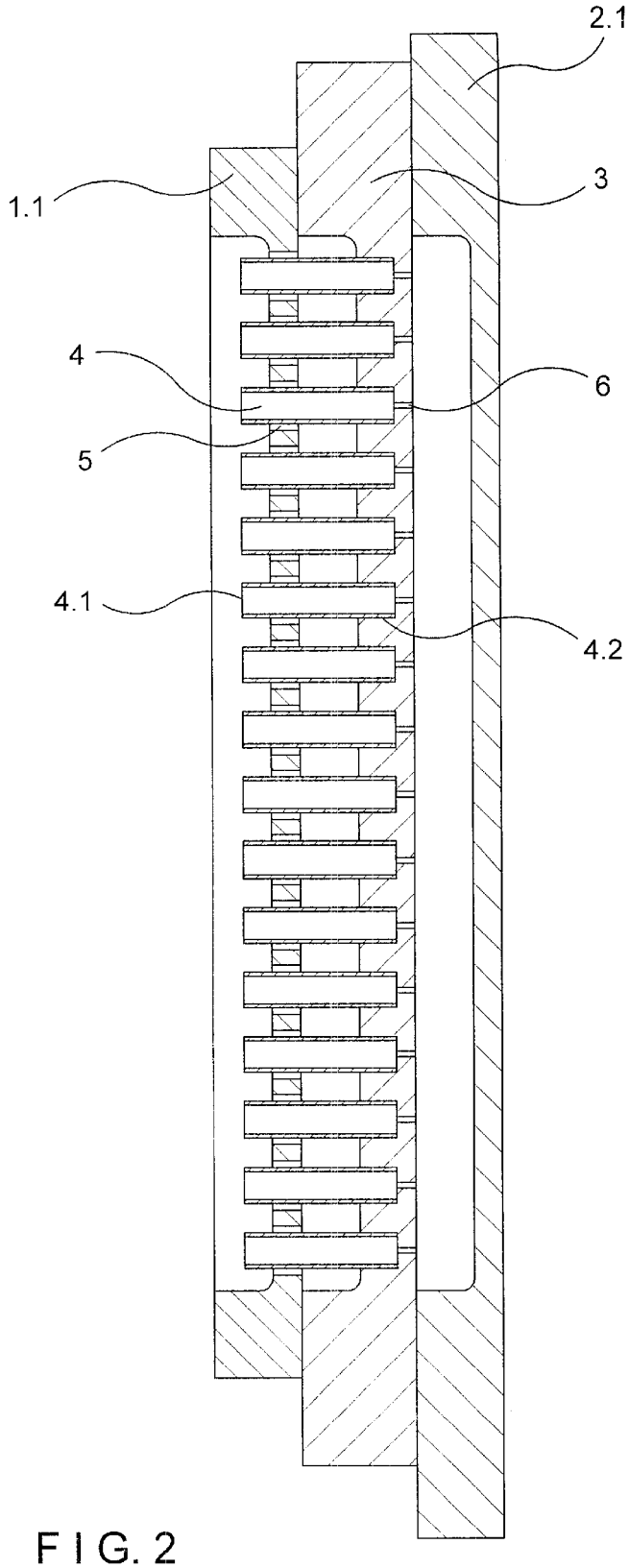
FIG. 2 shows a sectional side view of the exemplary embodiment illustrated in FIG. 1.

The first exemplary embodiment, which is illustrated in FIG. 1 and FIG. 2, essentially comprises a top tray 1.1, a bottom tray 2.1, an intermediate tray 3 and a large number of small tubes 4, of uniform dimensions, which are arranged in the form of a matrix and are secured at one end in amended paragraph below details such as connecting elements or any sealing elements which are not required in order to gain an understanding of the way in which the rinsing system functions. Measures of this type are a matter of course to the person skilled in the art and their design has no effect on the basic design of the rinsing tray system. An inlet 10 which is connected to the bottom tray 2.1 and via which the clean rinsing liquid is conveyed into the interior of the bottom tray 2.1 by means of a pump and an outlet 9 which is connected to the intermediate tray 3 and may be connected to a further pump are also not shown.

While the cleaning process is being carried out, the bottom tray 2.1 is filled continuously with clean rinsing liquid. The rinsing liquid rises up via the ducts 6 into the tubes 4 and flows over the edge of these tubes before then flowing out through, the clear area of the holes 5 into the intermediate tray 3. From there, the rinsing liquid can drain out via the outlet 9 through the force of gravity or can be removed by being pumped out.

To create identical flow conditions in all the tubes 4 irrespective of their distance from the inlet 10, the internal diameters of the ducts 6 are selected to be significantly smaller than the internal diameters of the tubes 4.

To allow the rising rinsing liquid to emerge from the tubes 4 without obstruction, tubes 4 with a small wall thickness are used. The wall thickness determines the rim area over which the rinsing liquid has to flow in the horizontal direction. To reduce this rim area, the tubes 4 may advantageously be chamfered.

The process of cleaning the pipette tips or transfer needles generally involves carrying out the rinsing process a number of times.

The rinsing process begins by the rinsing system and the matrix arrangement of pipette tips or transfer needles being positioned with respect to one another in such a way that the individual pipette tips or transfer needles are each aligned with and above a tube 4. As a result of the rinsing system being raised or the pipette tips or transfer needles being lowered, the latter are dipped into the tubes 4. In the process, the clean rinsing liquid flows around the outer surface of the pipette tips or transfer needles as a result of the flow generated in the tubes 4, and consequently this outer surface is cleaned.

In the case of the pipette tips, the interior of the pipette is filled with clean rinsing liquid by suction at the same time as the liquid is rinsing around its outer surface.

In the filled state, the pipette tips are raised again, or alternatively the rinsing system is lowered. A relative horizontal movement then follows, preferably by a distance of half the spacing between two adjacent tubes 4, and the pipette contents are released into the top tray 1.1.

The rinsing process can be repeated as often as desired without there being any need to completely change the clean rinsing liquid.

In this case, the efficiency of cleaning of the outer surface of the pipette tips or transfer needles is dependent solely on the time for which the clean rinsing liquid is flowing around this surface and on the flow velocity. The number of suction and expulsion cycles, i.e. the multiple repetition of the rinsing process, is the decisive factor for the efficiency of cleaning of the inner surface of the pipette tips.

Figure 3:
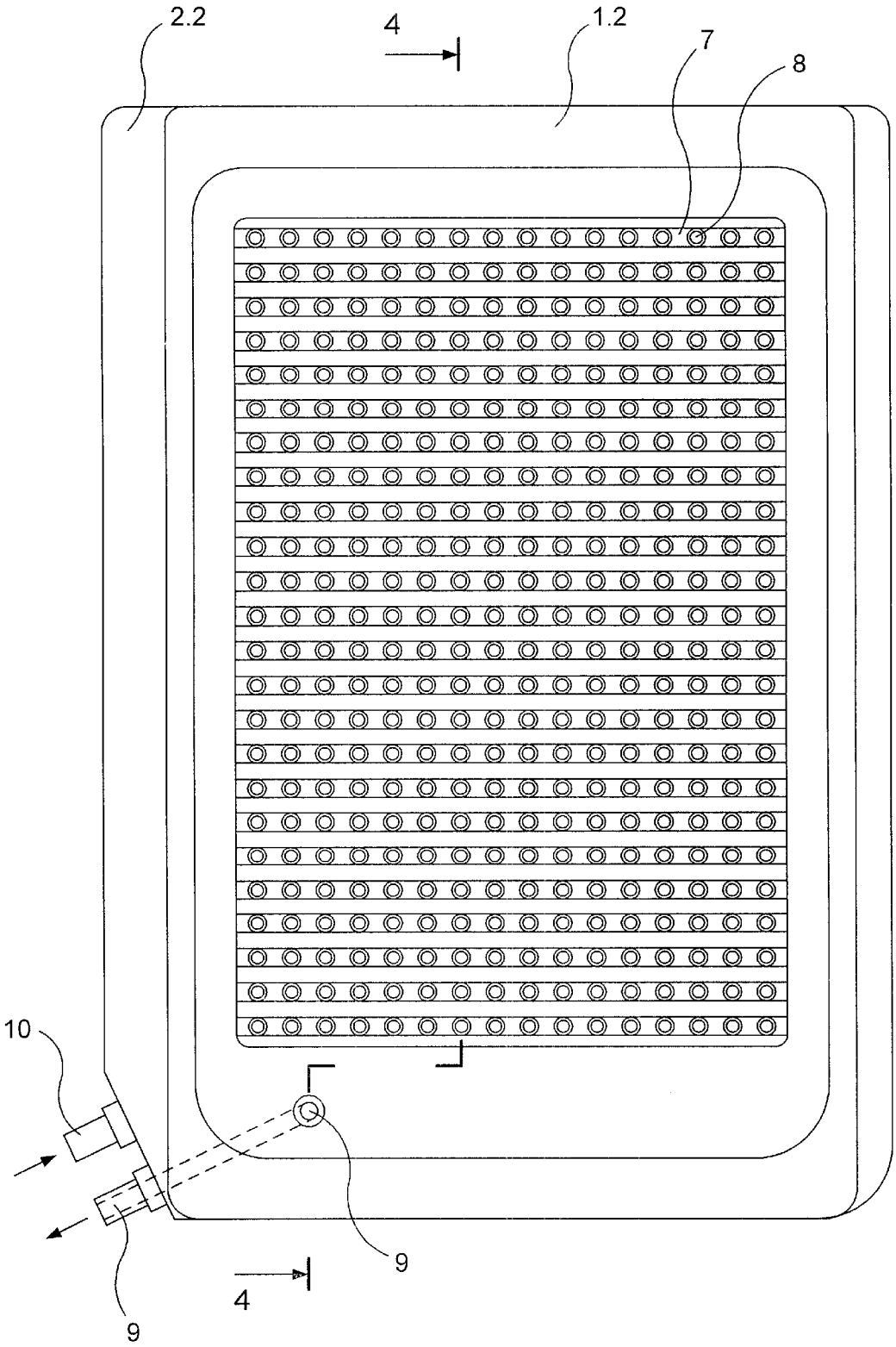
FIG. 3 shows a plan view of a second exemplary embodiment, in which the through-apertures are formed by through-bores located in webs.
Figure 4:
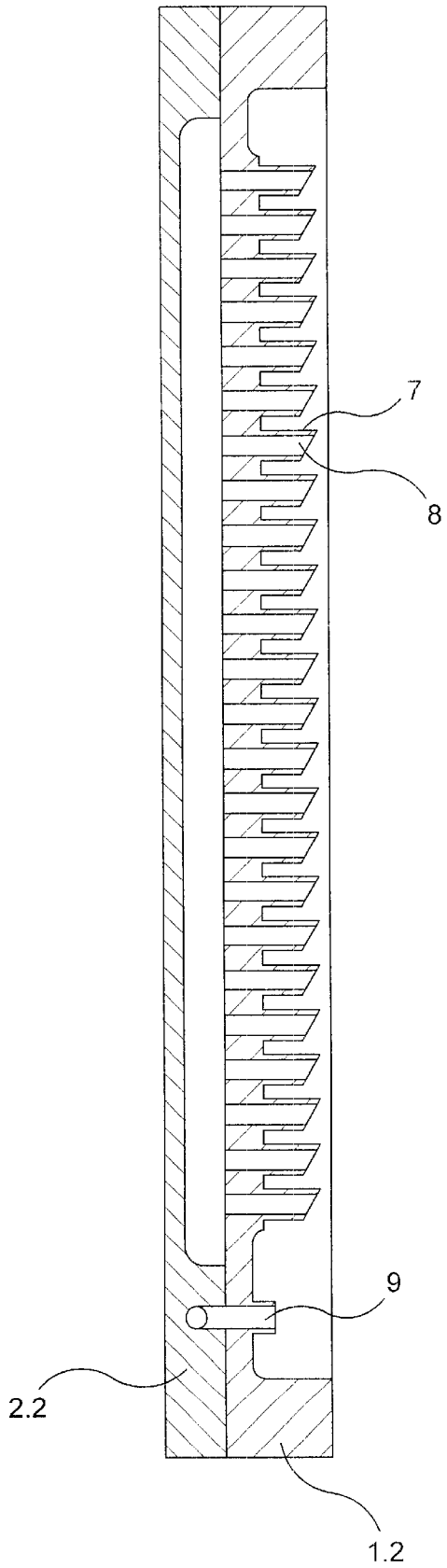
FIG. 4 shows a sectional side view of the exemplary embodiment illustrated in FIG. 3.

A design of a rinsing tray system according to the invention which is simpler to produce in technical terms is described in a second exemplary embodiment with reference to FIG. 3 and FIG. 4.

The second exemplary embodiment comprises a top tray 1.2 and a bottom tray 2.2, the base of the top tray 1.2 being designed in the form of adjacent webs 7 with through-bores 8.

In a similar way to the first exemplary embodiment, the bottom tray 2.2 is filled continuously with clean rinsing liquid via an inlet 10. In the process, the rinsing liquid rises upward via the through-bores 8 in the webs 7 and flows over their edge into the interior of the top tray 1.2. From here, the rinsing liquid can be pumped out via an outlet 9. Another essential factor is that the through-bores 8 be arranged at the same grid spacing as the pipette tips or transfer needles.

To ensure that there are no drops formed when the rinsing liquid emerges from the through-bores 8 and that the continuously supplied rinsing liquid can flow out, the rim area of the webs 7 around the through-bores should be designed as a plane surface which is inclined toward the base of the top tray 1.2, as shown in FIG. 4.

The top tray 1.2 is advantageously made from a hydrophobic material or coated with such a material, so that a cohesive film of liquid is formed therein, allowing the contaminated rinsing liquid to be sucked out uniformly.

While the foregoing description and drawings represent the preferred embodiments of the present invention, it will be obvious to one skilled in the art that various changes and modifications may be made therein without departing from the true spirit and scope of the present invention.

List of Reference Numerals

1.2 Top tray
2.1, 2.2 Bottom tray
3 Intermediate tray
4 Small tubes
4.1 Free end
4.2 Secured end
5 Holes
6 Ducts
7 Web
8 Through-bore
9 Outlet
10 Inlet

What is claimed is:

1. A rinsing tray system for pipette tips or transfer needles which are arranged in a grid spacing, the rinsing tray system comprising: an arrangement in the form of a matrix and having a bottom tray, an intermediate tray, and a top tray; the bottom tray having at least one inlet in order to be continuously filled with rinsing liquid; at least one outlet being present on the top tray; protrusions projecting into the interior of the top tray via holes arranged in a base of the top tray; said protrusions having through-apertures orientated at the same grid spacing from one another as the pipette tips or transfer needles and said protrusions projecting into the interior of the top tray perpendicularly to said base of the top tray; wherein the protrusions are narrow in an edge region around the through-apertures; wherein the protrusions are formed by free end pieces of thin-walled tubes having a rim area over which the rinsing liquid emerges from the protrusions after rinsing from the bottom tray to form a rinsing motion; and the protrusions are secured in the intermediate tray at a secured end.

2. The rinsing tray system as in claim 1, wherein the holes have a larger diameter than the external diameter of the thin-walled tubes, constituting said at least one outlet, and the intermediate tray having an end outlet in order for the rinsing liquid to be pumped out.

3. The rinsing tray system as in claim 1, wherein the tubes have an encircling chamfer at said edge region.

4. The rinsing tray system as in claim 1, wherein the protrusions form webs on the base of the top tray and the through-apertures are through-bores, in which system said edge region around the through-bores forms a plane'surface which is inclined with respect to the base of the top tray.

5. The rinsing tray system as in claim 1, wherein at least the top tray consists of a hydrophobic material or being coated with a hydrophobic material.

6. The rinsing tray system as in claim 1, wherein the grid spacing, that is, the center-to-center distance of the through-apertures, is smaller than 9 mm.

7. The rinsing tray system as in claim 6, wherein the grid spacing is 4.5 mm.

8. The rinsing tray system as in claim 6, wherein the grid spacing is 2.25 mm.

9. The rinsing tray system as in claim 6, wherein the grid spacing is 1.125 mm.

* * * * *